US011149941B2

(12) United States Patent
Prociw et al.

(10) Patent No.: US 11,149,941 B2
(45) Date of Patent: Oct. 19, 2021

(54) MULTIPOINT FUEL INJECTION FOR RADIAL IN-FLOW SWIRL PREMIX GAS FUEL INJECTORS

(71) Applicant: Delavan Inc., West Des Moines, IA (US)

(72) Inventors: Lev Alexander Prociw, Johnston, IA (US); Jason A. Ryon, Carlisle, IA (US)

(73) Assignee: Delavan Inc., West Des Moines, IA (US)

( * ) Notice: Subject to any disclaimer, the term of this patent is extended or adjusted under 35 U.S.C. 154(b) by 173 days.

(21) Appl. No.: 16/220,817

(22) Filed: Dec. 14, 2018

(65) Prior Publication Data

US 2020/0191383 A1 Jun. 18, 2020

(51) Int. Cl.

| | |
|---|---|
| ***F23C 7/00*** | (2006.01) |
| ***F23D 14/02*** | (2006.01) |
| ***F23D 14/70*** | (2006.01) |
| ***F23R 3/14*** | (2006.01) |
| ***F23R 3/28*** | (2006.01) |
| ***F23R 3/34*** | (2006.01) |

(52) U.S. Cl.

CPC ..... *F23C 7/004* (2013.01); *F23D 14/02* (2013.01); *F23D 14/70* (2013.01); *F23R 3/14* (2013.01); *F23R 3/286* (2013.01); *F23R 3/346* (2013.01); *F23C 2900/07001* (2013.01); *F23D 2900/14021* (2013.01)

(58) Field of Classification Search

CPC .... F23R 3/12; F23R 3/14; F23R 3/286; F23R 3/36; F23R 3/346; F23C 2900/07001; F23C 7/002; F23C 7/004; F23D 14/02; F23D 14/70; F23D 2900/14021; F02C 7/222; F02C 9/26; F02C 9/28

See application file for complete search history.

(56) References Cited

U.S. PATENT DOCUMENTS

| | | | | |
|---|---|---|---|---|
| 3,886,728 A * | 6/1975 | Quinn | F23R 3/30 | 60/39.23 |
| 4,499,735 A * | 2/1985 | Moore | F02C 7/228 | 60/739 |
| 5,319,935 A * | 6/1994 | Toon | F23C 6/047 | 239/403 |
| 5,323,614 A * | 6/1994 | Tsukahara | F23R 3/34 | 60/737 |

(Continued)

OTHER PUBLICATIONS

Extended European Search Report dated Mar. 18, 2020, issued during the prosecution of European Patent Application No. EP 192165025.

*Primary Examiner* — Alain Chau

(74) *Attorney, Agent, or Firm* — Locke Lord LLP; Joshua L. Jones; Scott D. Wofsy

(57) ABSTRACT

An injection system includes a radial swirler defining an axis and including a plurality of radial swirl vanes configured to direct a radially inward flow of compressor discharge air entering swirler inlets between the radial swirl vanes in a swirling direction around the axis. The radial swirler includes an outlet oriented in an axial direction to direct swirling compressor discharge air in an axial direction. An injector ring is included radially outward from of the swirler inlets. The fuel injector ring is aligned with the axis and includes a plurality of injection orifices directed towards the swirler inlets for injecting fuel into the radial swirler.

17 Claims, 4 Drawing Sheets

(56) References Cited

U.S. PATENT DOCUMENTS 5,361,586 A * 11/1994 McWhirter ..... F23R 3/34 60/737
5,394,688 A * 3/1995 Amos ..... F23C 7/006 60/39.23
5,408,825 A * 4/1995 Foss ..... F23R 3/36 60/39.463
5,479,782 A * 1/1996 Parker ..... F23C 7/006 60/747
5,647,215 A * 7/1997 Sharifi ..... F23D 17/002 60/737
5,713,206 A 2/1998 McWhirter et al.
5,761,906 A * 6/1998 Norster ..... F23C 7/002 60/737
5,816,049 A * 10/1998 Joshi ..... F23D 17/002 60/737
5,983,642 A * 11/1999 Parker ..... F02C 7/222 60/737
6,109,038 A * 8/2000 Sharifi ..... F23C 6/042 431/284
6,148,604 A * 11/2000 Salt ..... F01D 9/023 60/39.37
6,253,555 B1 * 7/2001 Willis ..... F23R 3/14 60/737
6,332,313 B1 * 12/2001 Willis ..... F23R 3/14 60/776
6,412,282 B1 * 7/2002 Willis ..... F23C 6/047 60/737
6,513,334 B2 * 2/2003 Varney ..... F23C 6/047 60/725
6,558,154 B2 * 5/2003 Eroglu ..... F02C 9/28 431/351
7,065,972 B2 * 6/2006 Zupanc ..... F23R 3/286 60/748
8,033,112 B2 10/2011 Milosavljevic et al.
8,181,464 B2 * 5/2012 Wilbraham ..... F23D 14/02 60/748
8,302,404 B2 * 11/2012 Nilsson ..... F23D 14/70 60/748
8,555,650 B2 * 10/2013 Kashihara ..... F23R 3/286 60/748
8,561,409 B2 * 10/2013 Milosavljevic ..... F23R 3/286 60/737
8,656,699 B2 * 2/2014 Saito ..... F23R 3/38 60/39.53
8,678,301 B2 * 3/2014 Hubbard ..... F23R 3/14 239/468
8,707,703 B2 * 4/2014 Kim ..... F23R 3/14 60/748
8,850,820 B2 * 10/2014 Milosavljevic ..... F23D 14/58 60/737
8,863,524 B2 * 10/2014 Karlsson ..... F23R 3/346 60/737
9,222,666 B2 * 12/2015 Liu ..... F23R 3/286
9,810,433 B2 * 11/2017 Sadasivuni ..... F02C 7/22
2001/0027637 A1 * 10/2001 Norster ..... F23D 14/24 60/773
2005/0252217 A1 11/2005 Chen et al.
2008/0041060 A1 * 2/2008 Nilsson ..... F23R 3/20 60/737
2009/0111063 A1 * 4/2009 Boardman ..... F23R 3/36 431/8
2011/0094240 A1 * 4/2011 Huitenga ..... F23R 3/14 60/776
2011/0101131 A1 * 5/2011 Milosavljevic ..... F23R 3/286 239/399
2011/0271682 A1 11/2011 Sandelis
2016/0334104 A1 * 11/2016 Yang ..... F02C 7/22

* cited by examiner

MULTIPOINT FUEL INJECTION FOR RADIAL IN-FLOW SWIRL PREMIX GAS FUEL INJECTORS

BACKGROUND OF THE INVENTION

1. Field of the Invention

The present disclosure relates to multipoint injection, and more particularly to multipoint fuel injection, e.g., for gas turbine engines.

2. Description of Related Art

Industrial gas turbine engines can employ radial inflow fuel/air mixers and usually use axially mounted fuel injectors. The actual fuel injection is limited to a relatively low number of injection sights, e.g., less than twenty injection sites.

The conventional techniques have been considered satisfactory for their intended purpose. However, there is an ever present need for improved fuel injection, e.g., for industrial gas turbine engines. This disclosure provides a solution for this need.

SUMMARY OF THE INVENTION

An injection system includes a radial swirler defining an axis and including a plurality of radial swirl vanes configured to direct a radially inward flow of compressor discharge air entering swirler inlets between the radial swirl vanes in a swirling direction with a circumferential component around the axis. The radial swirler includes an outlet oriented in an axial direction to direct swirling compressor discharge air mixed with fuel in an axial direction. An injector ring is included radially outward from the swirler inlets. The fuel injector ring is aligned with the axis and includes a plurality of injection orifices directed towards the swirler inlets for injecting fuel into the radial swirler.

The injector ring can be a first injector ring and a second injector ring can be included axially adjacent to the first injector ring, the second injector ring being aligned with the axis and including a plurality of injection orifices directed towards the swirler inlets for injecting fuel into the radial swirler, wherein the first and second injector rings are connected to two separate, fluidly isolated fuel circuits for staged fuel injection. A third injector ring can be included axially adjacent to the first and second injector rings, the third injector ring being aligned with the axis and including a plurality of injection orifices directed towards the swirler inlets for injecting fuel into the radial swirler, wherein the first, second, and third injector rings are connected to three separate, fluidly isolated fuel circuits for staged fuel injection.

There can be at least 200 injection orifices total among the first, second, and third injector rings. Each swirl vane can define a curved swirl profile extending from a leading edge of the vane to a trailing edge of the vane, wherein the curved swirl profile at the leading edge is normal to a circumference defined by the leading edges of the swirl vanes. There can be at least one of the injection orifices aligned with each of the swirler inlets, wherein the injection orifices are positioned to inject fuel between circumferentially adjacent swirl vanes without impinging fuel on the swirl vanes. There can be at least two injection orifices aligned with each swirler inlet.

A combustor case can enclose the radial swirler and the injector ring. A converging diverging outer wall can be included in the outlet of the radial swirler. A conical inner wall can be mounted inboard of the swirl vanes. A combustor liner can be included in board of the combustor case defining a combustion volume therein. The combustor liner can have an inlet connected to the radial swirler with the outlet of the radial swirler in fluid communication with the combustion volume. A fuel conduit can pass through a bulkhead of the combustor case and can connect to the injector ring for fluid connection of the injector ring to a source of fuel. Second and third injector rings as described above can be included and an exhaust emission gas sampling sensor can be mounted in an outlet of the combustor liner. A controller can be operatively connected to receive exhaust emission gas feedback from the exhaust emission gas sampling sensor. A plurality of electronic flow divider valves can be included, with one of the valves connected in each respective one of the fuel circuits. The electronic flow divider valves can be operatively connected to the controller for individual control of flow rates to each of the injector rings based on exhaust emission gas feedback.

A method of fuel injection includes issuing fuel through a plurality of axially adjacent injector rings into a radial swirler. The method includes varying flow rate through each of the injector rings individually to control exhaust gas emissions over varying engine operating conditions. The method can include using exhaust emission gas sampling feedback to control the flow rate through each of the injector rings.

A method of injecting includes directing fuel flow from an injector ring to a direction including a circumferential component.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
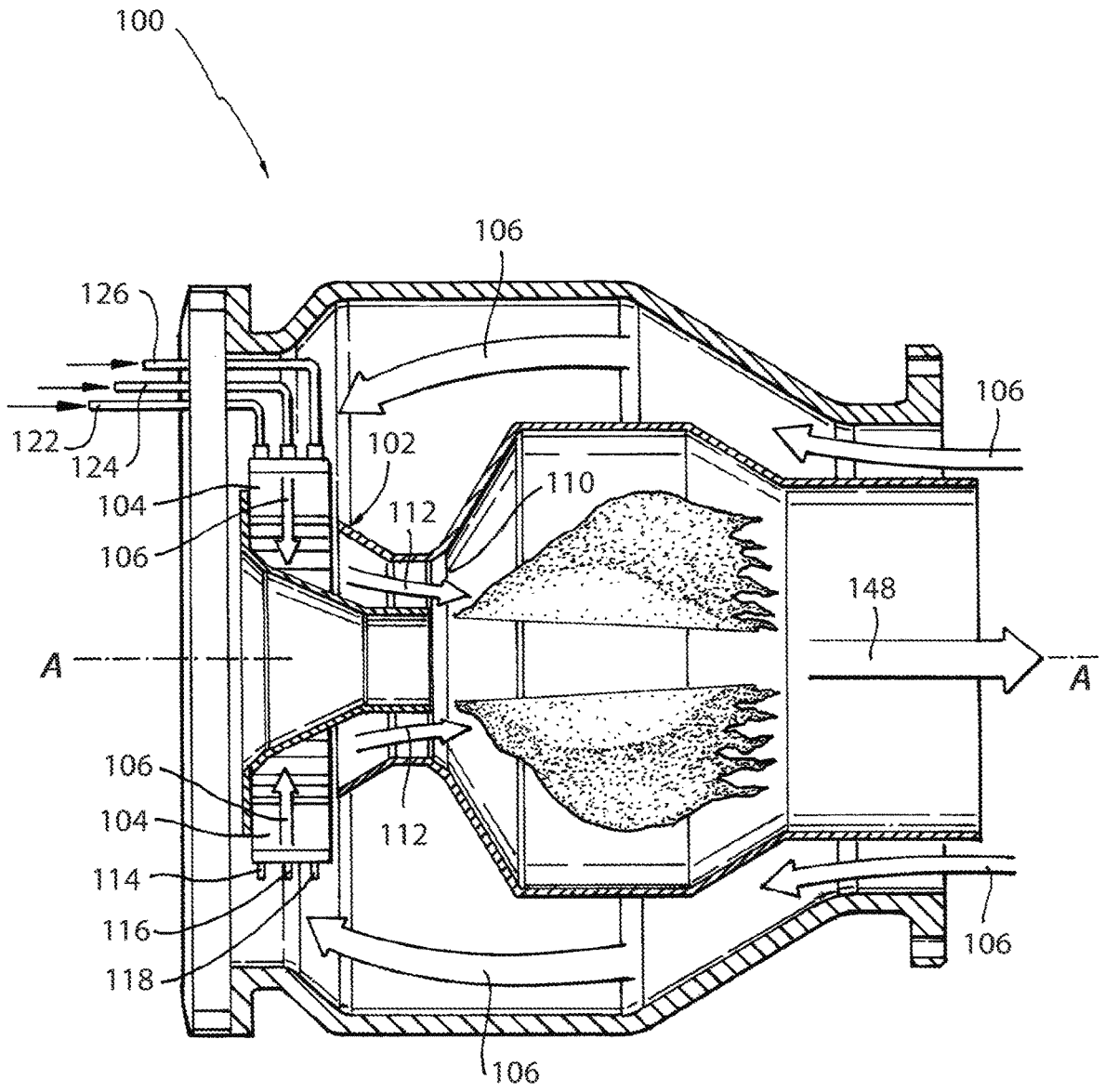
FIG. 1 is a cross-sectional side elevation view of an exemplary embodiment of an injection system constructed in accordance with the present disclosure, showing the radial swirler supplying compressor discharge air into a combustion volume.

Reference will now be made to the drawings wherein like reference numerals identify similar structural features or aspects of the subject disclosure. For purposes of explanation and illustration, and not limitation, a partial view of an exemplary embodiment of an injection system in accordance with the disclosure is shown in FIG. 1 and is designated generally by reference character 100. Other embodiments of injection systems in accordance with the disclosure, or aspects thereof, are provided in FIGS. 2-4, as will be described. The systems and methods described herein can be used for fuel injection, e.g., in industrial gas turbine engines.

The injection system 100 includes a radial swirler 102 defining an axis A and including a plurality of radial swirl vanes 104 configured to direct a radially inward flow of compressor discharge air, schematically represented by flow arrows 106, entering swirler inlets 108 (only a few of which are labeled in FIG. 2 for sake of clarity) between the radial swirl vanes 104 in a swirling direction with a circumferential component around the axis A. The swirl vanes 104 can be fabricated individually and assembled into the radial swirler 102. The circular arrow in FIG. 2 indicates the swirling direction. The radial swirler 102 includes an outlet 110 oriented in an axial direction relative to the axis A to direct swirling compressor discharge air mixed with fuel in an axial direction as indicated by the flow arrows 112 in FIG. 1. Three axially adjacent injector rings 114, 116, 118 are included outboard of (radially outward from) the swirler inlets 108 (shown in FIG. 2). Each fuel injector ring 114, 116, 118 is aligned with the axis A and includes a plurality of injection orifices 120 (only a few of which are identified in FIG. 3 for sake of clarity) directed towards the swirler inlets 108 for injecting fuel into the radial swirler 102. There are at least 200 injection orifices 120 total among the first, second, and third injector rings 114, 116, 118.

Figure 2:
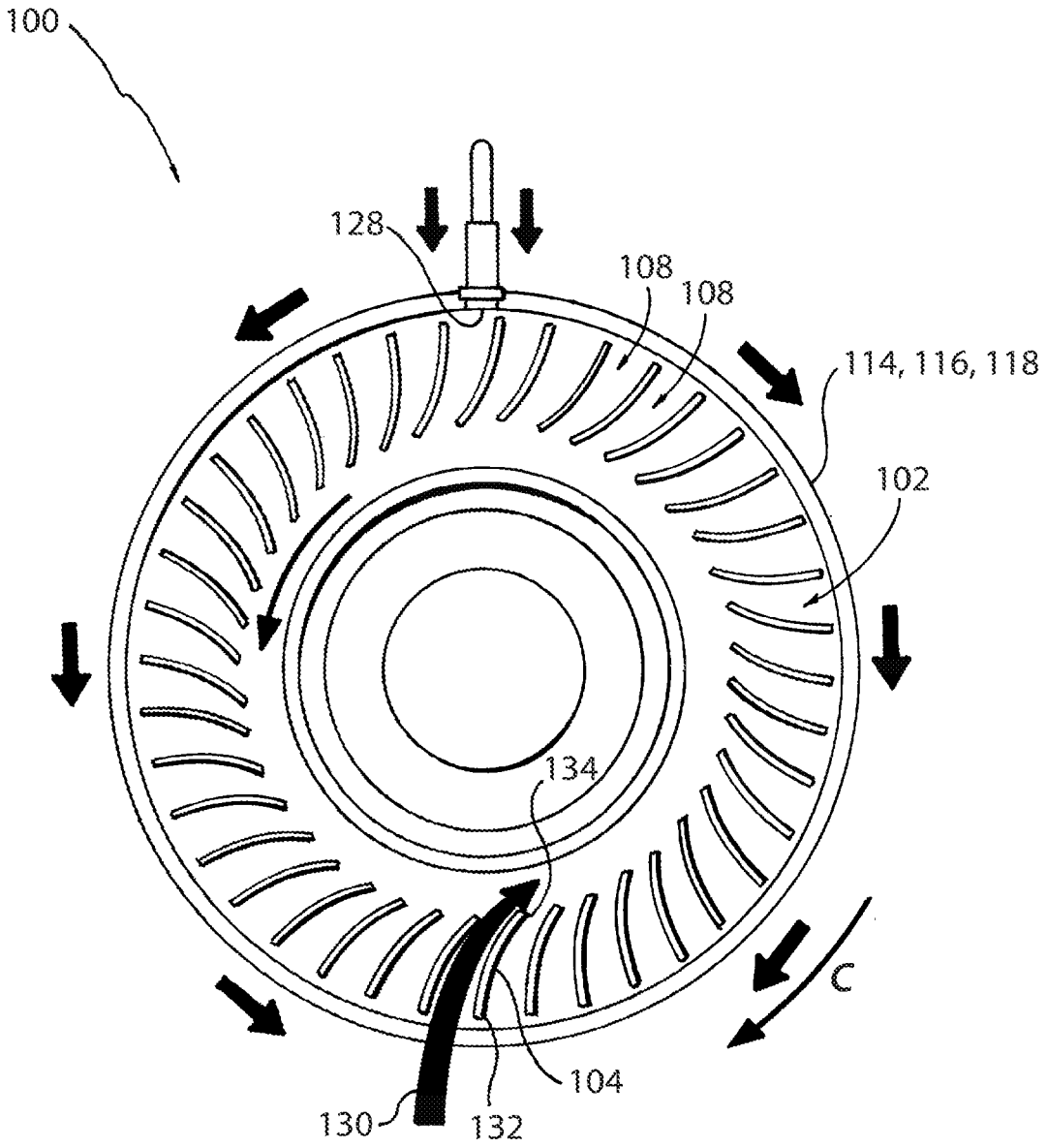
FIG. 2 is a an axial end view of a portion of the system of FIG. 1, showing the swirl vanes and injector rings.
Figure 3:
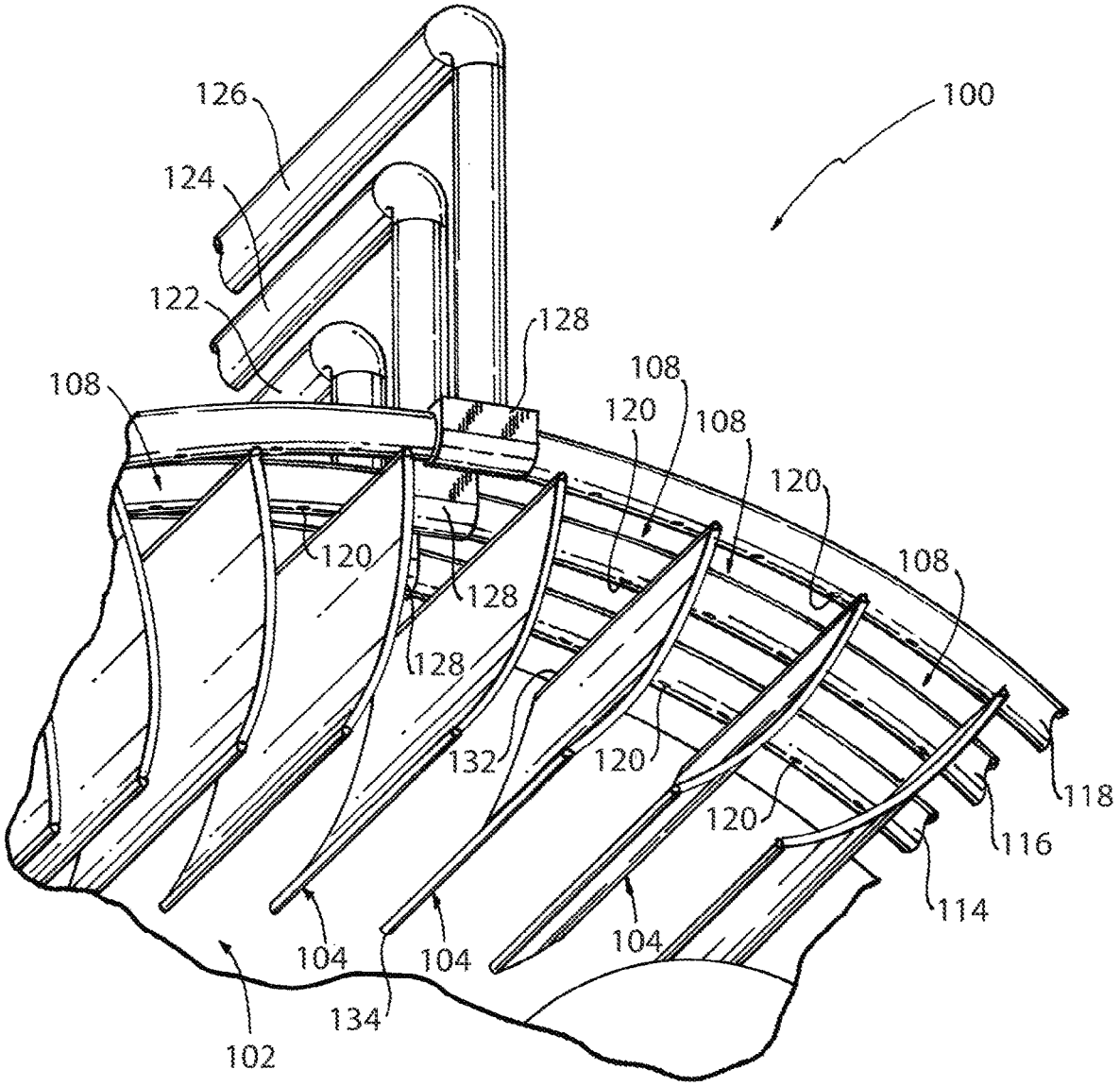
FIG. 3 is a perspective view of a portion of the system of FIG. 1, showing the injection orifices.

With reference to FIGS. 2-3, the first, second, and third injector rings 114, 116, 118 are connected to three separate, fluidly isolated fuel circuits, i.e. running through the conduits 122, 124, 126, for staged fuel injection. As shown in FIGS. 2 and 3, each conduit 122, 124, 126 terminates at a respective T-junction 128 to supply fuel to the injector rings simultaneously in the counter-clockwise and clockwise directions as indicated by the flow arrows in FIG. 2.

With reference to FIG. 2, each swirl vane 104 defines a curved swirl profile, schematically indicated in FIG. 2 with the arrow 130, extending from a leading edge 132 of the vane 104 to a trailing edge 134 of the vane 104. The curved swirl profile arrow 130, leading edge 132, and trailing edge 134 are labeled for only one of the swirl vanes 104 in FIG. 2 for the sake of clarity. The curved swirl profile at the leading edge 104 is normal to a circumference C defined by the leading edges 132 of the swirl vanes, and is normal to the circumference of the injection rings 114, 116, 118. As shown in FIG. 3, there is at least one or two of the injection orifices 120 aligned with each of the swirler inlets 108, and the injection orifices 120 are all positioned to inject fuel between circumferentially adjacent swirl vanes 104 without impinging fuel on the swirl vanes 104.

Figure 4:
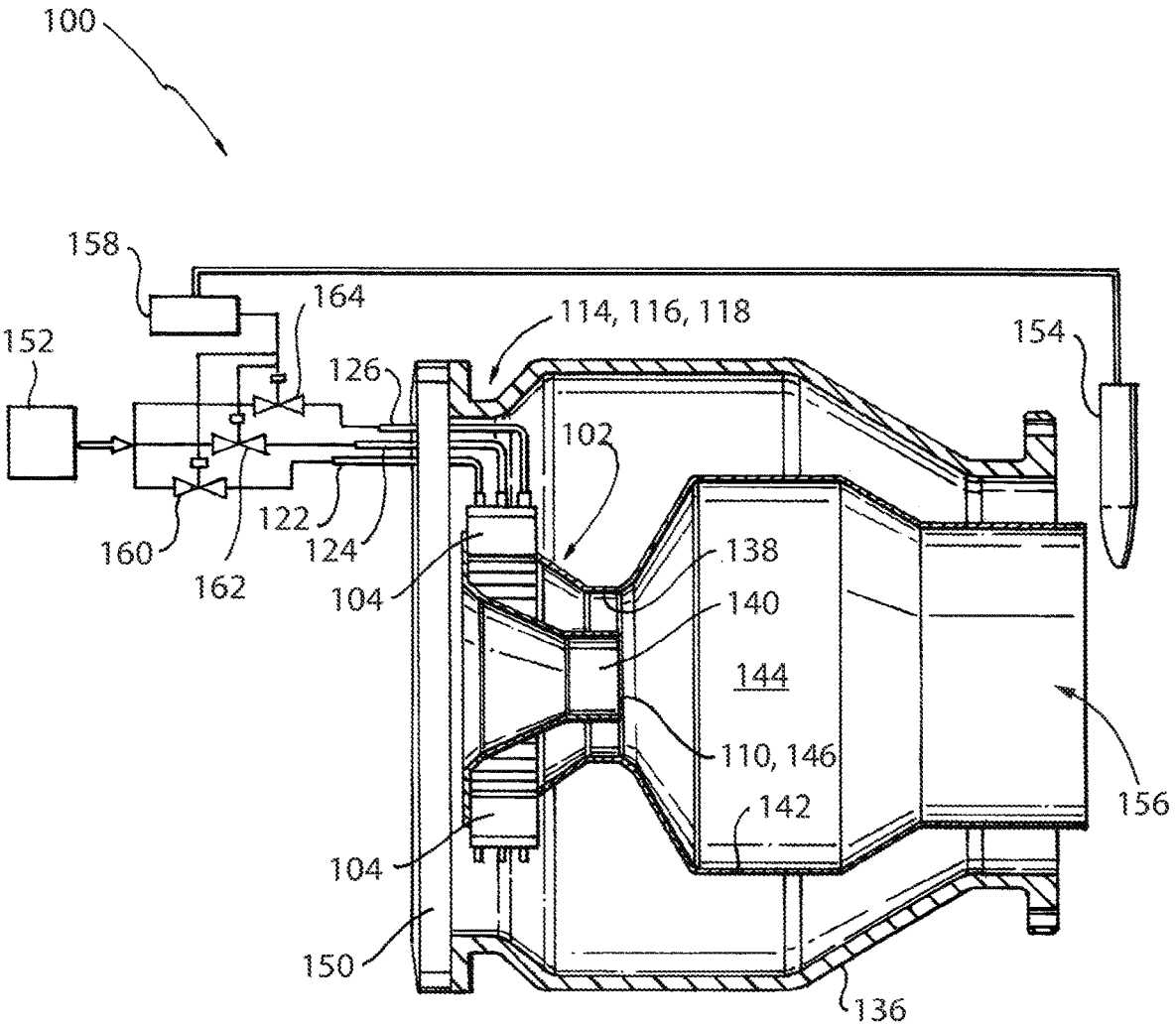
FIG. 4 is a cross-sectional side elevation view of the system of FIG. 1, showing a control system for controlling exhaust gas emissions.

With reference now to FIG. 4, a combustor case 136 encloses the radial swirler 102 and the injector rings 114, 116, 118. A converging diverging outer wall 138 is included in the outlet 110 of the radial swirler 112. A conical inner wall 140 is mounted inboard of the swirl vanes 104. A combustor liner 142 in board of the combustor case 136 defines a combustion volume 144 therein. The combustor liner 142 has an inlet 146 connected to the radial swirler 102 with the outlet 110 of the radial swirler 102 in fluid communication with the combustion volume 144 so a fuel air mixture from the radial swirler can combust and flow out of the combustion volume 144 as indicated in FIG. 1 by the large arrow 148. The fuel conduits 122, 124, 126 pass through a bulkhead 150 of the combustor case 136 and connect to the respective injector rings 114, 116, 118 for fluid connection of the injector rings 114, 116, 118 to a source 152 of fuel. An exhaust emission gas sampling sensor 154 is mounted in an outlet 156 of the combustor liner 136. A controller 158 is operatively connected to receive exhaust emission gas feedback from the exhaust emission gas sampling sensor 154. Respective electronic flow divider valves 160, 162, 164 are connected in each respective one of the fuel circuits 122, 124, 126. The electronic flow divider valves 160, 162, 164 are each operatively connected to the controller 158 for individual control of flow rates to each of the injector rings 114, 116, 118 based on exhaust emission gas feedback from the sensor 154.

A method of fuel injection includes issuing fuel through a plurality of axially adjacent injector rings, e.g., injector rings 114, 116, 118, into a radial swirler, e.g., swirler 102. The method includes varying flow rate through each of the injector rings individually to control exhaust gas emissions, e.g., by controlling the temperature profiles at the outlet 156, over varying engine operating conditions. The method can include using exhaust emission gas sampling feedback to control the flow rate through each of the injector rings. Controlling fuel flow through each injector ring controls mixing in air zones, air layers with greater flow can receive proportionally greater fuel flow. One or more injector ring can be shut off completely for fuel staging, e.g., for low power operation or for ignition. This controllability of the individual injector rings also allows adaptation, e.g., for changing hardware quality, fuel type, operating point, and the like.

The methods and systems of the present disclosure, as described above and shown in the drawings, provide for fuel injection, e.g., in industrial gas turbine engines, with superior properties including improved control of exhaust gas emissions over a range of engine operating conditions. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. An injection system comprising:

a radial swirler defining an axis and including a plurality of radial swirl vanes configured to direct a radially inward flow of compressor discharge air entering swirler inlets between the radial swirl vanes in a swirling direction with a circumferential component around the axis, wherein the radial swirler includes an outlet oriented in an axial direction to direct swirling compressor discharge air mixed with fuel in the axial direction;

a first injector ring radially outward from of the swirler inlets, wherein the fuel injector ring is aligned with the axis and includes a plurality of first injection orifices directed towards the swirler inlets for injecting fuel into the radial swirler; and at least one additional injector ring, wherein each of the first and additional injector rings is axially spaced apart from one another such that an axial airflow gap is provided between the first injector ring and the at least one additional injector ring, wherein each of the first injector ring and at least one additional injector ring are of the same diameter, and separately manifolded for staging.

2. The system as recited in claim 1, further comprising a second injector ring of the at least one additional injector ring axially adjacent to the first injector ring, the second injector ring being aligned with the axis and including a plurality of second injection orifices directed towards the swirler inlets for injecting fuel into the radial swirler, wherein the first and second injector rings are connected to two separate, fluidly isolated fuel circuits for staged fuel injection.

3. The system as recited in claim 2, further comprising a third injector ring of the at least one additional injector ring axially adjacent to the first and second injector rings, the third injector ring being aligned with the axis and including a plurality of third injection orifices directed towards the swirler inlets for injecting fuel into the radial swirler, wherein the first, second, and third injector rings are connected to three separate, fluidly isolated fuel circuits for staged fuel injection.

4. The system as recited in claim 3, wherein there are at least 200 injection orifices total among the first, second, and third injector rings.

5. The system as recited in claim 1, wherein each swirl vane defines a curved swirl profile extending from a leading edge of the vane to a trailing edge of the vane, wherein the curved swirl profile at the leading edge is normal to a circumference defined by the leading edges of the swirl vanes.

6. The system as recited in claim 1, wherein there is at least one of the first injection orifices aligned with each of the swirler inlets, wherein the at least one of the first injection orifices are positioned to inject fuel between circumferentially adjacent swirl vanes without impinging fuel on the swirl vanes.

7. The system as recited in claim 1, wherein there are at least two first injection orifices aligned with each swirler inlet.

8. The system as recited in claim 1, further comprising a combustor liner defining a combustion volume therein, wherein the combustor liner has an inlet connected to the radial swirler with the outlet of the radial swirler in fluid communication with the combustion volume.

9. The system as recited in claim 1, wherein the outlet of the radial swirler includes a converging diverging outer wall.

10. The system as recited in claim 1, further comprising a conical inner wall mounted inboard of the swirl vanes.

11. The system as recited in claim 1, further comprising a combustor case enclosing the radial swirler the first injector ring, and the at least one additional injector ring.

12. The system as recited in claim 11, further comprising:

a converging diverging outer wall in the outlet of the radial swirler;

a conical inner wall mounted inboard of the swirl vanes; and a combustor liner in board of the combustor case defining a combustion volume therein, wherein the combustor liner has an inlet connected to the radial swirler with the outlet of the radial swirler in fluid communication with the combustion volume.

13. The system as recited in claim 12, wherein a fuel conduit passes through a bulkhead of the combustor case and connects to the first injector ring and the at least one additional injector ring for fluid connection of the injector ring to a source of fuel.

14. The system as recited in claim 12, further comprising:

a second injector ring of the at least one additional injector ring axially adjacent to the first injector ring, the second injector ring being aligned with the axis and including a plurality of second injection orifices directed towards the swirler inlets for injecting fuel into the radial swirler, wherein the first and second injector rings are connected to two separate, fluidly isolated fuel circuits for staged fuel injection; and a third injector ring of the at least one additional injector ring axially adjacent to the first and second injector rings, the third injector ring being aligned with the axis and including a plurality of third injection orifices directed towards the swirler inlets for injecting fuel into the radial swirler, wherein the first, second, and third injector rings are connected to three separate, fluidly isolated fuel circuits for staged fuel injection.

15. The system as recited in claim 14 further comprising:

an exhaust emission gas sampling sensor mounted in an outlet of the combustor liner;

a controller operatively connected to receive exhaust emission gas feedback from the exhaust emission gas sampling sensor; and a plurality of electronic flow divider valves, with one of the valves connected in each respective one of the fuel circuits, wherein the electronic flow divider valves are operatively connected to the controller for individual control of flow rates to each of the injector rings based on exhaust emission gas feedback.

16. A method of fuel injection comprising:

issuing fuel through a plurality of axially adjacent injector rings into a radial swirler, wherein the plurality of injector rings are of the same diameter and separately manifolded for staging, wherein the injector rings are axially spaced apart from one another such that an axial airflow gap is provided between the injector rings; and varying flow rate through each of the injector rings individually to control exhaust gas emissions over varying engine operating conditions.

17. The method as recited in claim 16, further comprising using exhaust emission gas sampling feedback to control the flow rate through each of the injector rings.

* * * * *